US005171176A

United States Patent [19]

Gebhardt et al.

[11] Patent Number: 5,171,176

[45] Date of Patent: Dec. 15, 1992

[54] METHOD AND APPARATUS FOR DECELERATING A MARINE PROPULSION SYSTEM DURING AN EMERGENCY STOP MANEUVER

[75] Inventors: Hans Gebhardt, Langenzenn; Heribert Kubis, Nuremburg, both of Fed. Rep. of Germany

[73] Assignee: MAN Nutzfahrzeuge Aktiengesellschaft, Munich, Fed. Rep. of Germany

[21] Appl. No.: 792,816

[22] Filed: Nov. 15, 1991

[30] Foreign Application Priority Data

Nov. 16, 1990 [DE] Fed. Rep. of Germany ..... 4036578

[51] Int. Cl.[5] ..... B63H 23/08

[52] U.S. Cl. ..... 440/75; 192/0.084; 192/51

[58] Field of Search ..... 192/0.084, 0.096, 0.098, 192/51; 74/404; 440/75, 84, 86

[56] References Cited

U.S. PATENT DOCUMENTS 1,394,448 10/1921 Sitney ..... 192/51
3,363,732 1/1968 Nakamura et al. ..... 192/0.094 X
3,543,891 12/1970 Mathers ..... 192/0.094 X

*Primary Examiner*—Sherman Basinger
*Attorney, Agent, or Firm*—Robert W. Becker & Associates

[57] ABSTRACT

A method and apparatus for decelerating a marine propulsion system during an emergency stop maneuver is provided. In order to achieve a faster reversal of the direction of rotation of a propeller shaft an engine brake is activated before switching the three shaft birotatory reduction gear system in order to decelerate the engaged and rotating gear system parts effectively. Only when the rotation of the gear system parts has been reduced to a predetermined number of revolutions the gear system is switched to the reversed direction of rotation by a control switch on the bridge so that the propeller shaft is rotating in the reversed direction of rotation and subsequently the number of revolutions of the combustion engine is increased to full load. The emergency stop maneuver may be performed in a very short period of time with the proposed method. The apparatus comprises a motor brake having a throttle valve eccentrically supported in the exhaust pipe of the combustion engine.

2 Claims, 2 Drawing Sheets

METHOD AND APPARATUS FOR DECELERATING A MARINE PROPULSION SYSTEM DURING AN EMERGENCY STOP MANEUVER

BACKGROUND OF THE INVENTION

The present invention relates to a method of decelerating a marine propulsion system during an emergency stop maneuver, whereby the marine propulsion system comprises a combustion engine, a propeller shaft and an interposed three shaft birotatory reduction gear system, comprising a synchromesh coupling and a counter rotation coupling. The birotatory reduction gear system is switchable by a control switch to an idling position, a forward drive position and a backward drive position, whereby the control switch also allows adjustment of the number of revolutions and output of the combustion engine.

In general, marine propulsion systems are comprised of a three shaft birotatory reduction gear system which is interposed between the combustion engine and the propeller shaft. In these reduction gear systems the toothed wheels are always in engagement. The switching of the reduction gear system is achieved by engagement or disengagement of hydraulically activated couplings. The couplings are activated from the bridge via a control switch and corresponding electro-hydraulic valves. During idling both couplings are disengaged. When the combustion engine and the propeller shaft are rotating synchronously, a synchromesh coupling is engaged, and when the combustion engine and the propeller shaft are counter rotating, a counter rotation coupling is engaged while at the same time the respective other coupling is disengaged. A disadvantage of such a birotatory reduction gear system is that, when a fast reversal of the direction of rotation is required, a high wear will occur at the coupling disks due to the inertia moments of the couplings, the toothed wheels of the propeller shaft and of the propeller itself. It is thus possible that the combustion engine stalls or will start up again in the reverse direction of rotation.

It is therefore an object of the present invention to provide a method with which a fast reversal of the direction of rotation of the propeller shaft is possible without the couplings of the birotatory reduction gear system wearing at a high rate and without running the risk that the combustion engine will stall or will start up again in the reverse direction of rotation.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
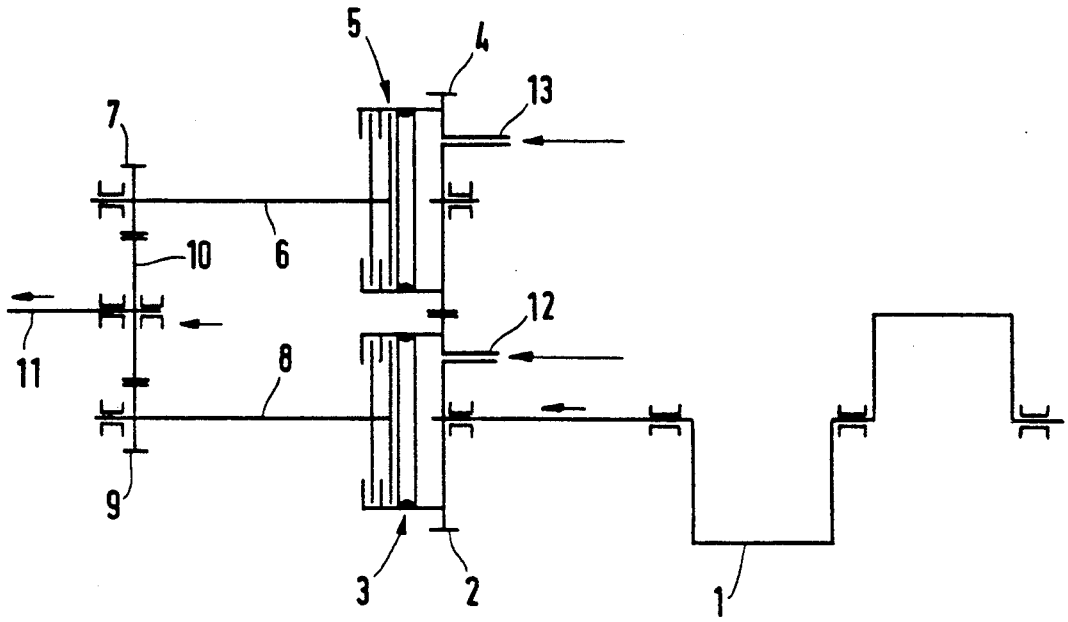
FIG. 1 is a schematic representation of a three shaft birotatory reduction gear system with a combustion engine, a propeller shaft and control switch.

The method of the present invention is primarily characterized by the following steps: When beginning the emergency stop maneuver for reversing a direction of rotation of the marine propulsion system, reducing the number of revolutions and the output of the combustion engine to idling; activating an engine brake of the combustion engine and simultaneously maintaining engagement of the synchromesh coupling until the number of revolutions has been reduced to a predetermined rate; subsequently, disengaging the synchromesh coupling and engaging the counter rotation coupling; and, after engagement of the counter rotation coupling, adjusting the number of revolutions of the combustion engine to full load.

Due to the fact that the synchromesh coupling remains engaged before the birotatory reduction gear system is switched from its forward drive position to its backward drive position and due to the simultaneous activation of the engine brake, the propeller shaft is immediately slowed down at a fast rate. Only when the number of revolutions of the combustion engine has been reduced to a predetermined value the birotatory reduction gear system is switched, for example, by switching the control switch into the backward drive position. Due to the engine brake and the resulting reduction of the number of revolutions of the reduction gear system parts which are in a torque-locking engagement, the rotation energy is substantially reduced. This will result in a high deceleration of the number of revolutions and accordingly a fast reversal of the direction of rotation during an emergency stop maneuver as well as a great reduction of the frictional work at the couplings and the resulting wear. Furthermore, the combustion engine will not stall and a start-up of the combustion engine in a reversed direction of rotation is avoided.

The invention is further concerned with an apparatus for decelerating a marine propulsion system during an emergency stop maneuver. As described above, the marine propulsion system comprises a combustion engine, a propeller shaft and an interposed three shaft birotatory reduction gear system with a synchromesh coupling and a counter rotation coupling. The birotatory reduction gear system is switchable by a control switch to an idling position, a forward drive position and a backward drive position. The control switch allows also adjustment of a number of revolutions of the combustion engine. According to the present invention, the apparatus comprises an engine brake for the combustion engine, the engine brake comprising a throttle valve that is eccentrically supported in an exhaust pipe of the combustion engine. When beginning the emergency stop maneuver for reversing the direction of rotation of the marine propulsion system, the number of revolutions and the output of the combustion engine is adjusted to idling, the engine brake is activated and, simultaneously, engagement of the synchromesh coupling is maintained until the number of revolutions has been reduced to a predetermined rate. Subsequently, the synchromesh coupling is disengaged while the counter rotation coupling is engaged, and the number of revolutions of the combustion engine is adjusted to full load. Due to the eccentricity of the throttle valve, the throttle valve is maintained in an open position by the gas pressure in the exhaust pipe during normal operation of the engine. Only when the engine brake is activated, the throttle valve is switched to a closed position.

The engine brake allows for a substantially wear-free deceleration of the propeller shaft and the reduction gear system parts. The high deceleration of the reduction gear system parts results in a fast reversal of the direction of rotation of the propeller shaft and thus in a high deceleration of the ship. When the throttle valve of the engine brake is closed in the warming-up phase of the combustion engine the emission of white smoke is reduced due to the faster warming of the system, which is a desirable side effect.

DESCRIPTION OF THE PREFERRED EMBODIMENTS

The present invention will now be described in detail with the aid of several specific embodiments, utilizing FIGS. 1 through 3.

FIG. 1 is a schematic representation of a three shaft birotatory reduction gear system of a marine propulsion system. A combustion engine 1 drives a first toothed wheel 2 with a counter rotation coupling 3. The first toothed wheel 2 is in engagement with a second toothed wheel 4 and a synchromesh coupling 5. The synchromesh coupling 5 is provided with a shaft 6 having fixedly connected thereto a first pinion 7. The counter rotation coupling 3 is provided with a counter rotation shaft 8 which has fixedly connected thereto a second pinion 9. The two pinions 7 and 9 engage a third toothed wheel 10 which, in return, is fixedly connected to a drive shaft, for example, the propeller shaft 11.

The counter rotation coupling 3 may be hydraulically engaged by a first hydraulic oil line 12, and the synchromesh coupling 5 may be hydraulically engaged by a second hydraulic oil line 13. The hydraulic oil supply may be controlled from the bridge via a control switch 14 (FIG. 2).

When both hydraulic oil lines 12, 13 are pressureless, the combustion engine 1 is idling.

When the second hydraulic oil line 13 is activated by switching the control switch 14 on the bridge into the position 1 (FIG. 2) the synchromesh coupling 5 is engaged while the counter rotation coupling 3 is disengaged. The second toothed wheel 4 is in a torque-locking engagement with the shaft 6 so that the propeller shaft 11 rotates synchronously with the combustion engine 1.

When the first hydraulic oil line 12 is activated by switching the control switch 14 on the bridge into the position III (FIG. 2) the counter rotation coupling 3 is engaged while the synchromesh coupling 5 is disengaged. The combustion engine 1 is thus directly connected via the counter rotation coupling 3 to the counter rotation shaft 8 in a torque-locking engagement whereby the propeller shaft 11 rotates in a direction counter to the direction of rotation of the combustion engine 1.

A requirement for passenger-carrying ships is that the ship should be stopped in a fast manner by reversing the direction of rotation of the propeller shaft 11 in order to prevent collisions. For this purpose the three shaft birotatory reduction gear system as described above is only suitable to a limited extent. The main disadvantage is that all of the toothed wheels and the pinions 2, 4, 7, 9, 10 are in constant engagement. These reduction gear system parts as well as the propeller shaft and the propeller have a high rotation energy. When the direction of rotation of the propeller shaft 11 is to be reversed during an emergency stop maneuver, the rotating masses must be first stopped by removing their rotation energy before a reversal of the direction of rotation may be initiated In the previously known methods the synchromesh coupling 5 is first disengaged. However, since the counter rotation shaft 8, due to the pinion 9, rotates in a direction opposite to the rotation direction of the combustion engine 1, it is required, that before the engagement of the counter rotation coupling 3 for the desired reversal of the direction of rotation of the propeller shaft takes place, the counter rotation shaft 8 together with the propeller shaft 11 (which is in a torque-locking engagement with the counter rotation shaft 8) and the shaft 6 together with the synchromesh coupling 5 must be decelerated before a reversal of the direction of rotation may be achieved.

It is therefore easily understood that in order to achieve a fast reversal of the direction of rotation a high wear is observed at the counter rotation coupling 3 since it must perform the frictional work for the transformation, respectively, compensation of the rotation energy of the reduction gear system parts. When the reversal of the direction of rotation is performed too fast it is possible that the combustion engine 1 will stall or may start up in the reverse direction of rotation.

A constructively expensive solution to this problem would be either a propeller shaft brake system or an increase of the rotating masses at the primary side of the system in order to prevent stalling of the combustion engine.

An elegant solution to the problem is provided by the inventive method. When an emergency stop maneuver is performed an engine brake, which, for example, comprises a throttle valve 18 that is eccentrically supported in the exhaust pipe 17 of the engine, (FIG. 1) is activated first while simultaneously the synchromesh coupling 5 is maintained in engagement. Thus, the engaged reduction gear system parts and the propeller shaft 11 are decelerated to a predetermined number of revolutions which depends on the inertia of the rotating parts and must be determined depending on the system such that after the disengagement of the synchromesh coupling 5 the number of revolutions of the counter rotation shaft 8 before engaging the counter rotation coupling 3 is reduced to nearly zero before the number of revolutions may be increased again.

Thus, the wear of the counter rotation coupling 3 is substantially reduced since it must not compensate the counter rotational movements of the reduction gear system parts 7, 9, 10, 11 resulting from the forward drive position. Furthermore, a start-up of the combustion engine 1 in the reverse direction of rotation is avoided.

Figure 2:
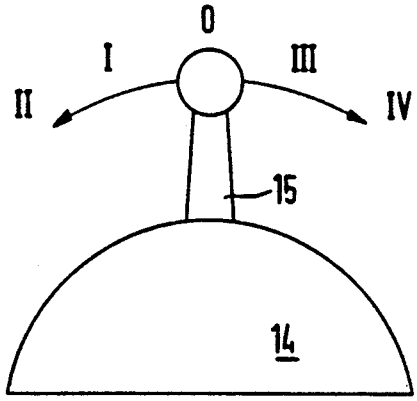
FIG. 2 shows a control switch with its switching positions.

The switching of the birotatory reduction gear system, in general, is achieved by a control switch 14 on the bridge which is represented schematically in FIGS. 1 and 2. The control switch 14 is provided with a control lever 15 for switching the control unit into the positions 0 to IV. It is further connected via line 16 to the engine 1. The switching position 0 corresponds to idling, i.e., the synchromesh coupling 5 and the counter rotation coupling 3 (FIG. 1) are disengaged. The switching positions I, respectively, III correspond to forward drive, respectively, backward drive whereby either the synchromesh coupling 5 or the counter rotation coupling 3 is respectively engaged and the corresponding other coupling is disengaged. Beyond the positions I or III, that is, between the positions I and II, respectively, III and IV, the load of the combustion engine 1 is controlled, whereby at the positions II and IV full load is reached (position II corresponds to forward drive and position IV corresponds to backward drive).

During an emergency stop maneuver the control switch 14 is first arrested in position I until the number of revolutions of the propeller shaft 11 (FIG. 1) has been reduced, only then a switching from the position I via the position 0 into the position III for backward drive may take place.

However, it is also possible that the course of events for the emergency stop maneuver as described with the aid of FIG. 1 may be achieved by activating an emergency stop switch which activates an electronic control system that controls the deceleration maneuver of the present invention while the control switch 14 is turned off.

Figure 3:
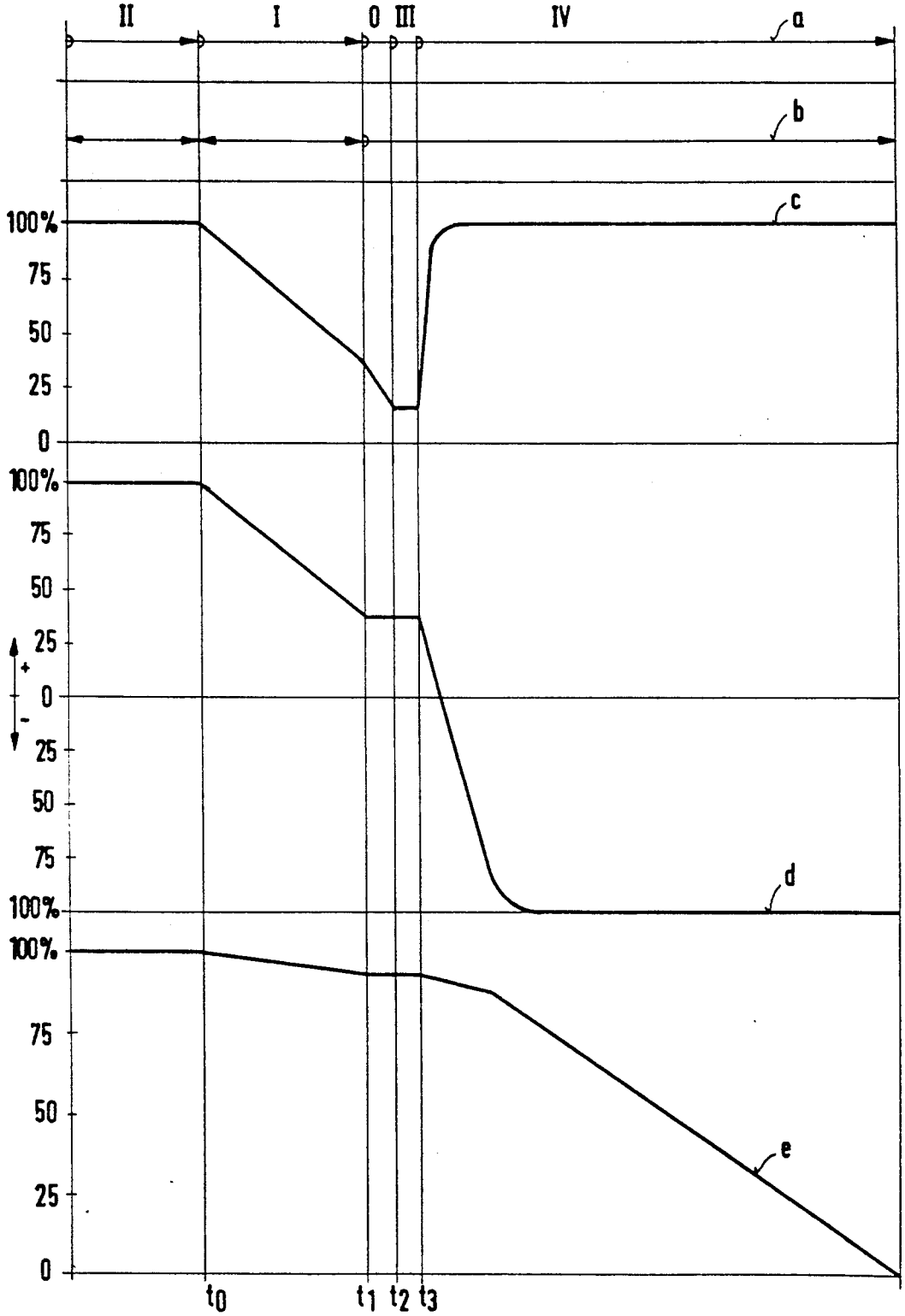
FIG. 3, is a diagram of various parameters as a function of time.

The course of the deceleration maneuver is qualitatively represented in the diagram of FIG. 3.

Curve a represents the position of the control switch 14 of FIG. 2.

At full speed in forward drive the control switch assumes the position II.

Accordingly, the throttle valve of the engine brake is open, see curve b. In position II, the number of revolutions of the combustion engine corresponds to 100% as represented in curve c. Under partial load the number of revolutions is reduced correspondingly by sliding the control switch toward position I.

The number of revolutions of the propeller shaft that corresponds to the position II is 100% of the nominal number of revolution of the combustion engine and is represented in curve d.

The speed of the ship, as shown in curve e, is constant and corresponds to 100%.

At the time $t_0$ the emergency stop maneuver begins. According to the present invention, the control switch 14 (FIG. 2) is moved to position I as shown in curve a. It is an essential feature of the present invention that the control switch 14 be maintained in position I until the propeller shaft is almost completely decelerated.

According to curve b, at the time $t_0$ the throttle valve of the engine brake is closed and the propeller shaft and the reduction gear system parts in the position forward drive are decelerated by the engine brake. According to curve d, the deceleration reaches approximately 40% of the nominal number of revolutions of the propeller shaft. Due to the reduction of the number of revolutions of the combustion engine the velocity of the ship is slightly reduced, as can be seen in curve e.

In the time period between $t_1$ and $t_2$, the control switch 14, after release of the position I due to the reduced number of revolution, is moved into the position 0 and the throttle valve is opened. The birotatory reduction gear system is now in its idling position. The number of revolutions of the combustion engine according to curve c is further reduced until at $t_2$ the number of revolutions for the idling stage is achieved. The number of revolutions of the propeller and the velocity of the ship remain essentially unchanged.

After moving the control switch 14 into the position III at $t_3$, the reversal of the direction of rotation of the birotatory reduction gear system and the connected propeller shaft takes place. The number of revolutions of the combustion engine and the number of revolutions of the propeller shaft are constant as can be seen from the curves c and d. The velocity of the ship is slightly reduced due to its own resistance, as can be seen in curve e.

At $t_3$ the control switch 14 (FIG. 2) is moved from position III toward position IV. A control rod of the combustion engine is pushed into its full load position. According to curve c, the number of revolutions of the combustion engine is quickly increased as is the number of revolutions of the propeller shaft, coupled to the combustion engine via the birotatory reduction gear system, as can be seen in curve d. The direction of rotation of the propeller shaft is, of course, reversed. Accordingly, the velocity of the ship is greatly reduced as can be seen in curve e.

According to the present invention the reversal of direction of rotation is substantially accelerated due to the deceleration of the propeller shaft and the simultaneous closure of the throttle valve of the engine brake. The couplings of the three shaft birotatory reduction gear system are thus protected from wear, and a change in the direction of rotation of the combustion engine is definitely avoided.

In order to perform the inventive method the control switch 14 may be fixed in position I by mechanical arresting means until the propeller shaft is decelerated.

Advantageously, the method may also be performed in an electronic manner by activating an emergency stop switch which deactivates the control switch 14 during the emergency stop maneuver and which controls the three shaft birotatory reduction gear system with a respective program such that the inventive method is performed.

A further advantage of the method is that during a cold start procedure the throttle valve 18 of the engine brake may be closed for a short period of time so that the resulting increased exhaust work remains in the combustion engine in the form of heat thereby reducing the warm up period which results in a reduction of white smoke.

The present invention is, of course, in no way restricted to the specific disclosure of the specification and drawings, but also encompasses any modifications within the scope of the appended claims.

What we claim is:

1. A method of decelerating a marine propulsion system during an emergency stop maneuver, said marine propulsion system comprising a combustion engine, a propeller shaft and an interposed three shaft birotatory reduction gear system, comprising a synchromesh coupling and a counter rotation coupling, said birotatory reduction gear system being switchable by a control switch to an idling position, a forward drive position and a backward drive position, said control switch allowing also adjustment of a number of revolutions and output of said combustion engine; said method including the steps of:

when beginning the emergency stop maneuver for reversing a direction of rotation of said marine propulsion system, reducing the number of revolutions and the output of said combustion engine to idling;

activating an engine brake of said combustion engine and simultaneously maintaining engagement of said synchromesh coupling until the number of revolutions has been reduced to a predetermined rate;

subsequently, disengaging said synchromesh coupling and engaging said counter rotation coupling; and after engagement of said counter rotation coupling, adjusting the number of revolutions of said combustion engine to full load.

2. An apparatus for decelerating a marine propulsion system during an emergency stop maneuver, said marine propulsion system comprising a combustion engine, a propeller shaft and an interposed three shaft birotatory reduction gear system, comprising a synchromesh coupling and a counter rotation coupling, said birotatory reduction gear system being switchable by a control switch to an idling position, a forward drive position and a backward drive position, said control switch allowing also adjustment of a number of revolutions and output of said combustion engine; said apparatus in combination comprising:

an engine brake for said combustion engine, said engine brake comprising a throttle valve that is eccentrically supported in an exhaust pipe of said combustion engine, whereby, when beginning the emergency stop maneuver for reversing a direction of rotation of said marine propulsion system, the number of revolutions and output of said combustion engine is reduced to idling, said engine brake is activated and simultaneously engagement of said synchromesh coupling is maintained until the number of revolutions has been reduced to a predetermined rate, and subsequently, said synchromesh coupling is disengaged while said counter rotation coupling is engaged, and the number of revolutions of said combustion engine is adjusted to full load.

* * * * *